US007386258B2

(12) United States Patent
Jang et al.

(10) Patent No.: US 7,386,258 B2
(45) Date of Patent: Jun. 10, 2008

(54) COUPLING MEANS FOR DEVELOPMENT ROLLER OF DEVELOPING UNIT AND ELECTROPHOTOGRAPHIC IMAGE FORMING APPARATUS HAVING THE SAME

(75) Inventors: Kyung-hwan Jang, Cheonan-si (KR); Won-mo Cho, Suwon-si (KR); Yong-whan Park, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 249 days.

(21) Appl. No.: 11/071,367

(22) Filed: Mar. 4, 2005

(65) Prior Publication Data

US 2005/0244191 A1 Nov. 3, 2005

(30) Foreign Application Priority Data

May 3, 2004 (KR) ..... 10-2004-0030935

(51) Int. Cl.
*G03G 15/06* (2006.01)

(52) U.S. Cl. ..... 399/222; 399/279

(58) Field of Classification Search ..... 399/36, 399/119, 167, 222, 262, 279
See application file for complete search history.

(56) References Cited

U.S. PATENT DOCUMENTS

2001/0028806 A1* 10/2001 Makino
2005/0169670 A1* 8/2005 Noh ..... 399/167

FOREIGN PATENT DOCUMENTS

| | | | |
|---|---|---|---|
| JP | 61-099169 | | 5/1986 |
| JP | 01-179185 | | 7/1989 |
| JP | 05-027582 | | 2/1993 |
| JP | 09311552 A | * | 12/1997 |
| JP | 2000-214654 | | 8/2000 |
| JP | 2002-341696 | | 11/2002 |
| KR | 1994-013303 | | 6/1994 |
| KR | 10-1997-049035 | | 9/1997 |

* cited by examiner

*Primary Examiner*—David M. Gray
*Assistant Examiner*—Laura K Roth
(74) *Attorney, Agent, or Firm*—Roylance, Abrams, Berdo & Goodman, L.L.P.

(57) ABSTRACT

A developer includes a developer frame in which a developing agent is contained, a development roller that is rotatably disposed inside the developer frame. Coupling means couples the development roller to the developer frame. The coupling means includes a gear member that is rotatably mounted to the developer frame and engages a first gear disposed outside the developer to transfer a rotational force. A development roller end portion rotates with the gear member in the same direction about the same rotational shaft as the gear member. An image forming apparatus includes a photosensitive medium on which an electrostatic latent image corresponding to an image to be printed is formed through light scanning and the developer, which applies a developing agent to the photosensitive medium to develop the image into a visible image.

20 Claims, 5 Drawing Sheets

COUPLING MEANS FOR DEVELOPMENT ROLLER OF DEVELOPING UNIT AND ELECTROPHOTOGRAPHIC IMAGE FORMING APPARATUS HAVING THE SAME

CROSS REFERENCE TO RELATED APPLICATIONS

This application claims the benefit under 35 U.S.C. § 119(a) of Korean Patent Application No. 10-2004-0030935, filed on May 3, 2004, in the Korean Intellectual Property Office, the entire disclosure of which is hereby incorporated by reference.

BACKGROUND OF THE INVENTION

1. Field of the Invention

The present invention relates to an electrophotographic image forming apparatus. More particularly, the present invention relates to a developer having a development roller with an improved rotational structure, and an electrophotographic image forming apparatus including the developer.

2. Description of the Related Art

Generally, image forming apparatuses, such as laser printers and digital copying machines, are devices that scan light to a photosensitive medium that is charged at a predetermined potential to form an electrostatic latent image on an outer peripheral surface of the photosensitive medium. A developing agent, such as toner, is applied to the electrostatic latent image to develop the latent image into a visible image. The image is transferred and fixed to a sheet of paper to print the image. An electrophotographic image forming apparatus includes a developer that is detachably mounted inside a body. The developer includes the photosensitive medium, which has the electrostatic latent image formed on the outer peripheral surface thereof, and a development roller, which conveys the toner to the outer peripheral surface of the photosensitive medium. The developer is replaced with a new developer when the toner contained therein is depleted.

Power for rotating the photosensitive medium or the development roller during the printing process is transferred from a motor disposed inside the body. If the developer is mounted inside the body for the power transfer, the motor and the developer are coupled to each other using predetermined coupling means. FIG. 1 is an exploded perspective view of coupling means for coupling the developer to the motor in a conventional electrophotographic image forming apparatus.

Referring to FIG. 1, the coupling means includes a triangular protrusion 11, which extends in a longitudinal direction of a photosensitive drum 5 from a front end portion of a rotary shaft 10 of the photosensitive drum 5. A power transfer shaft 20 that is rotatably connected to a motor (not shown) has a triangular groove 22 facing the triangular protrusion 11. The power transfer shaft 20 is operatively connected to a door (not shown) of the image forming apparatus that is opened to allow a developer including the photosensitive drum 5 to be installed in or removed from the image forming apparatus therethrough, such that the power transfer shaft 20 moves forward and backward in a direction indicated by the arrow when the door is opened and closed. The rotary shaft 10 of the photosensitive drum 5 is inserted into an aperture 17 formed in a developer frame 15 such that the photosensitive drum 5 is rotatably mounted to the developer frame 15. Accordingly, the triangular protrusion 11 is exposed outside of the developer frame 15.

If the door is opened to mount the developer in a body of the image forming apparatus, the power transfer shaft 20 moves rearwardly. If the developer is inserted in the body of the image forming apparatus and the door is closed, the power transfer shaft 20 moves forwardly, thereby inserting the triangular protrusion 11 of the photosensitive drum 5 in the triangular groove 11 such that the motor inside the body is connected to the photosensitive drum 5 inside the developer. Consequently, if the motor rotates according to a printing order, the power of the motor is transferred to the photosensitive drum 5 to rotate the photosensitive drum 5.

Alternatively, a gear portion 7 is disposed on an outer peripheral surface of a longitudinal end of the photosensitive drum 5. A corresponding gear portion (not shown) meshing with the gear portion 7 of the photosensitive drum 5 is disposed on an outer peripheral surface of a longitudinal end of each of a development roller, a supply roller, and an agitator inside the developer. Accordingly, if the photosensitive drum 5 rotates, the development roller, the supply roller, and the agitator rotate subsequently.

As described above, since the power transfer shaft 20 is operatively connected to the door and thus moves forwardly and rearwardly when the door is opened and closed, the power transfer shaft 20 has a complex structure and requires many components, thereby increasing manufacturing costs and increasing the difficulty of manufacturing the power transfer shaft 20. The rotational speed of the development roller, which is geared with the photosensitive drum to rotate, may vary according to a degree to which teeth of the gear portion 7 of the photosensitive drum 5 and teeth of the gear portion of the development roller are processed. This may result in a jittery printed image.

Further, the development roller engaged with the photosensitive drum 5 is forced to be farther from or closer to the photosensitive drum 5 as the photosensitive drum 5 rotates. Accordingly, a gap between an outer peripheral surface of the photosensitive drum 5 and an outer peripheral surface of the development roller may be different from a preset value, which adversely affects the quality of the printed image.

Accordingly, there is a need for a developer having an improved rotational structure for an electrophotographic image forming apparatus to improve print quality.

SUMMARY OF THE INVENTION

The present invention provides a developer including a development roller mounted inside a developer frame with an improved rotational structure, and an electrophotographic image forming apparatus having the developer.

According to an aspect of the present invention, a developer includes a developer frame in which a developing agent is contained. A development roller is rotatably disposed inside the developer frame. Coupling means couples the development roller to the developer frame. The coupling means includes a gear member that is rotatably mounted to the developer frame. The gear member meshes with a first gear disposed outside the developer to transfer a rotational force. A development roller end portion rotates with the gear member in the same direction and about the same rotational shaft.

The gear member may include a gear portion meshing with the first gear. The gear portion may pass through the developer frame to be exposed outside of the developer frame.

A first protrusion may protrude from the gear member toward the development roller, and a second protrusion may protrude from the development roller end portion toward the gear member. A disc may be disposed between the gear member and the development roller end portion to receive the first protrusion and the second protrusion. When the gear member rotates the first protrusion moves to rotate the disc, and the rotating disc moves the second protrusion to rotate the development roller end portion.

A supply roller for supplying the developing agent to the development roller and an agitator for stirring the developing agent may be disposed inside the developer frame. The development roller is geared with the agitator such that if the development roller rotates, the supply roller and the agitator rotate together with the development roller.

A photosensitive medium on which an electrostatic latent image corresponding to an image to be printed is formed thereon through light scanning may be disposed inside the developer frame. The photosensitive medium rotates meshing with a second gear disposed outside the developer to transfer a rotational force.

According to another aspect of the present invention, an electrophotographic image forming apparatus includes a photosensitive medium on which an electrostatic latent image corresponding to an image to be printed is formed through light scanning; and a developer for applying a developing agent to the photosensitive medium to develop the image into a visible image. The developer includes a developer frame in which the developing agent is contained. A development roller is rotatably disposed inside the developer frame. Coupling means couples the development roller to the developer frame. The coupling means includes a gear member that is rotatably mounted to the developer frame. The coupling means meshes with a first gear disposed outside the developer to transfer a rotational force. A development roller end portion rotates with the gear member in the same direction about the same rotational shaft as the gear member.

The gear member may include a gear portion meshing with the first gear, and the gear portion may pass through the developer frame to be exposed outside of the developer frame.

A first protrusion may protrude from the gear member toward the development roller, and a second protrusion may protrude from the development roller end portion toward the gear member. A disc may be disposed between the gear member and the development roller end portion to receive the first protrusion and the second protrusion. When the gear member rotates, the first protrusion moves to rotate the disc, and the rotating disc moves the second protrusion to rotate the development roller end portion.

A supply roller for supplying the developing agent to the development roller and an agitator for stirring the developing agent may be disposed inside the developer frame. The supply roller and the agitator are geared with the development roller such that if the development roller rotates, the supply roller and the agitator rotate together with the development roller.

The photosensitive medium may be positioned inside the developer frame. The photosensitive medium rotates and meshes with a second gear disposed outside the developer to transfer a rotational force.

The first gear and the second gear may be driven by different motors.

The electrophotographic image forming apparatus may further include buffer means that supports the first gear to prevent damage due to a confliction between the first gear and the gear member.

The buffer means may include a bracket that rotatably supports the first gear, and a spring that elastically supports the bracket.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings, in which exemplary embodiments of the invention are shown.

Figure 1:
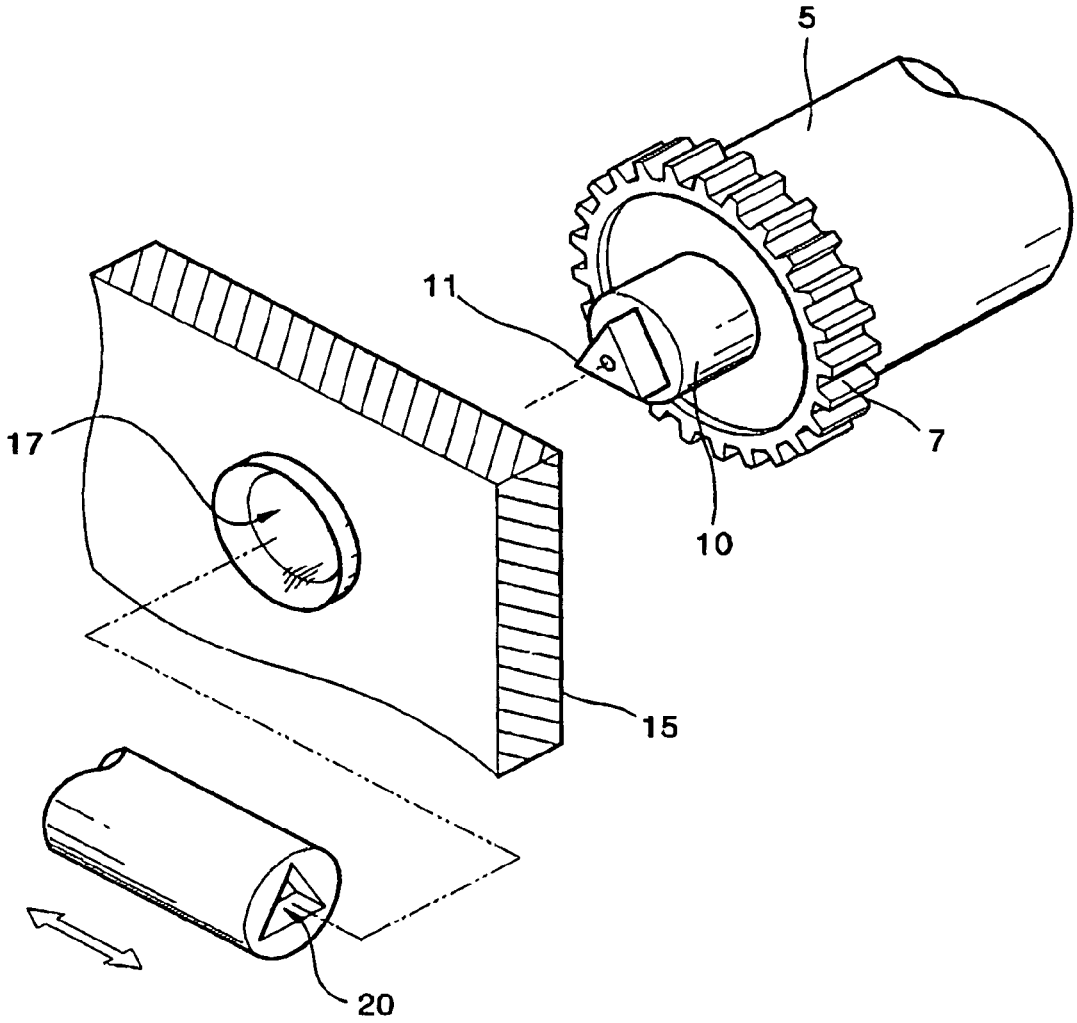
FIG. 1 (PRIOR ART)
FIG. 1 is an exploded perspective view of coupling means for coupling a developer to a motor in a conventional electrophotographic image forming apparatus.
Figure 2:
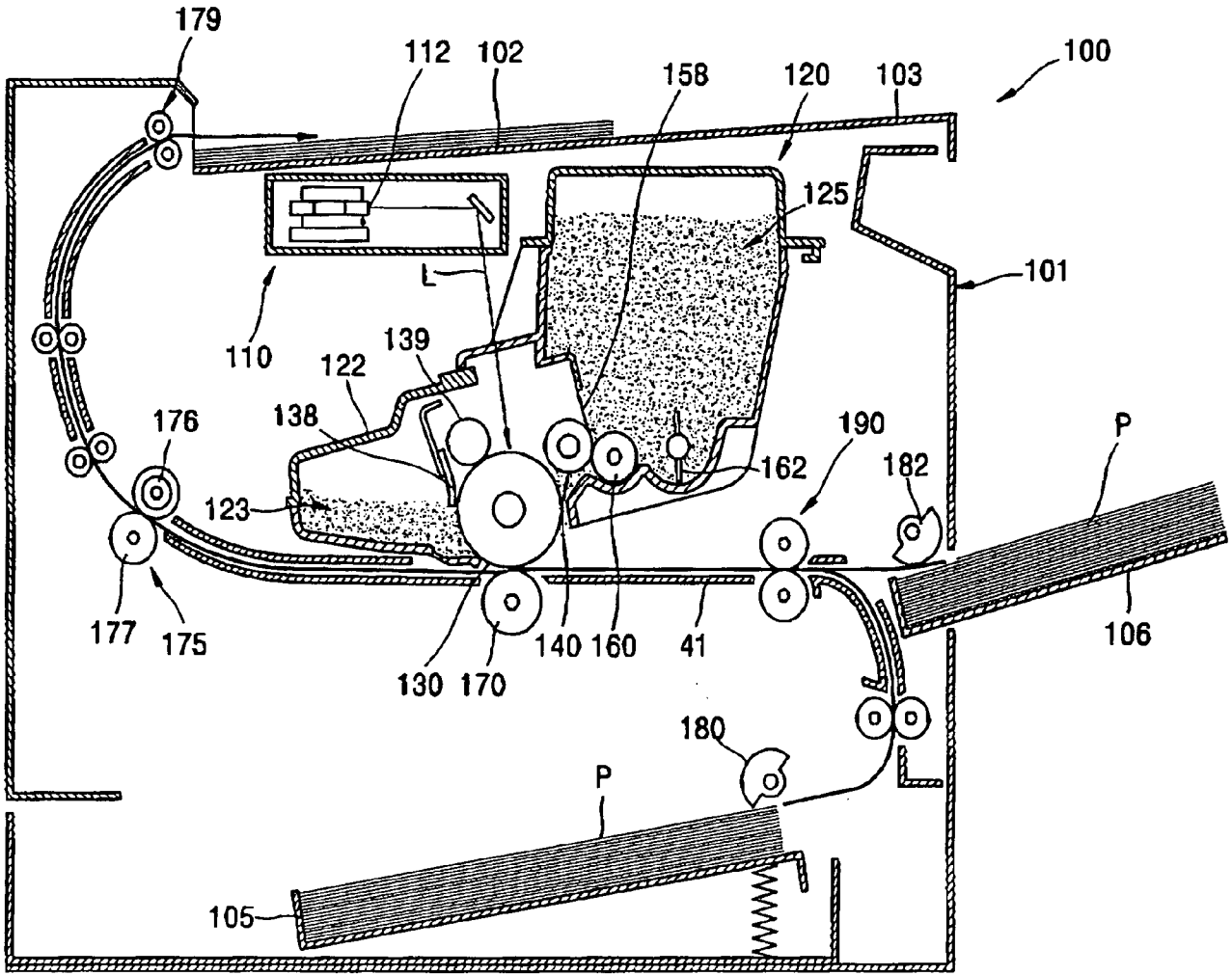
FIG. 2 is a schematic sectional view of an electrophotographic image forming apparatus according to an exemplary embodiment of the present invention.
Figure 3:
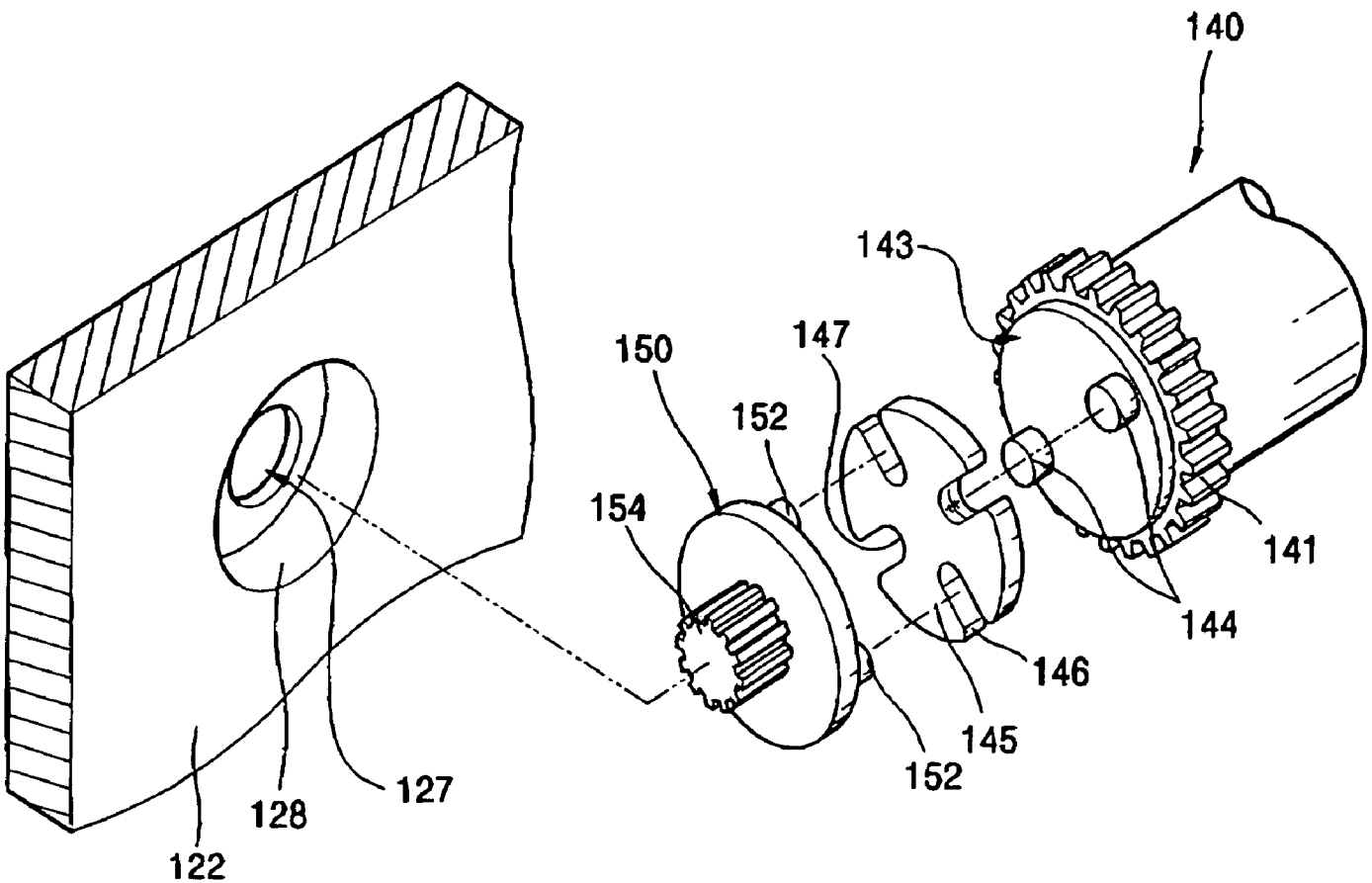
FIG. 3 is an exploded perspective view of coupling means for coupling a development roller inside a developer to a motor outside the developer in the electrophotographic image forming apparatus of FIG. 2.
Figure 4:
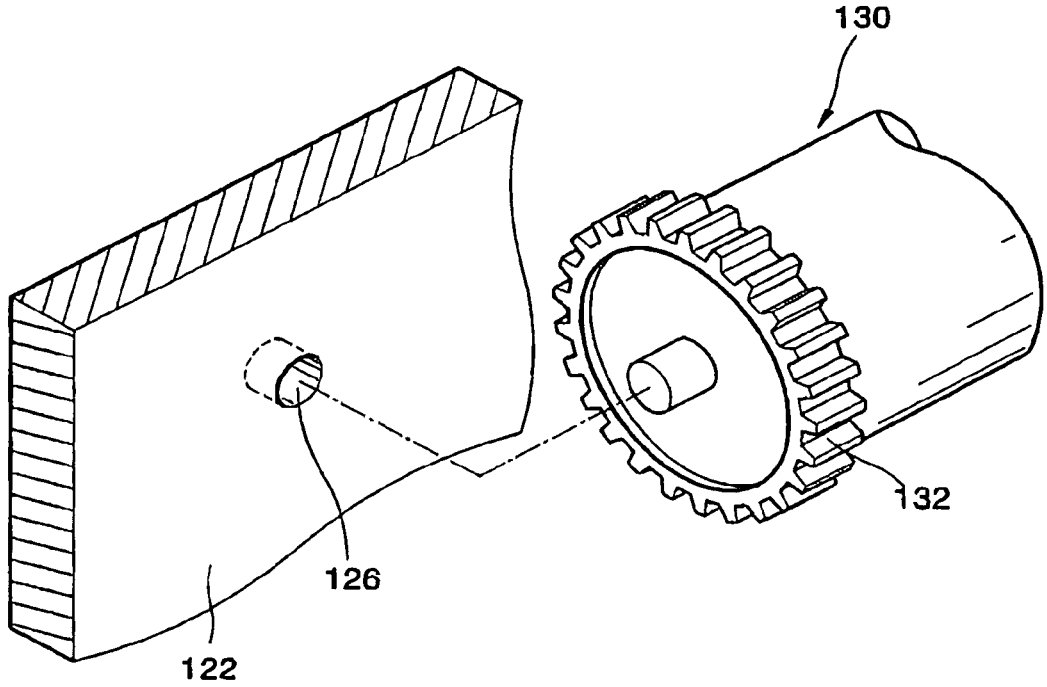
FIG. 4 is an exploded perspective view of a photosensitive drum inside the developer of the electrophotographic image forming apparatus of FIG. 2.
Figure 5:
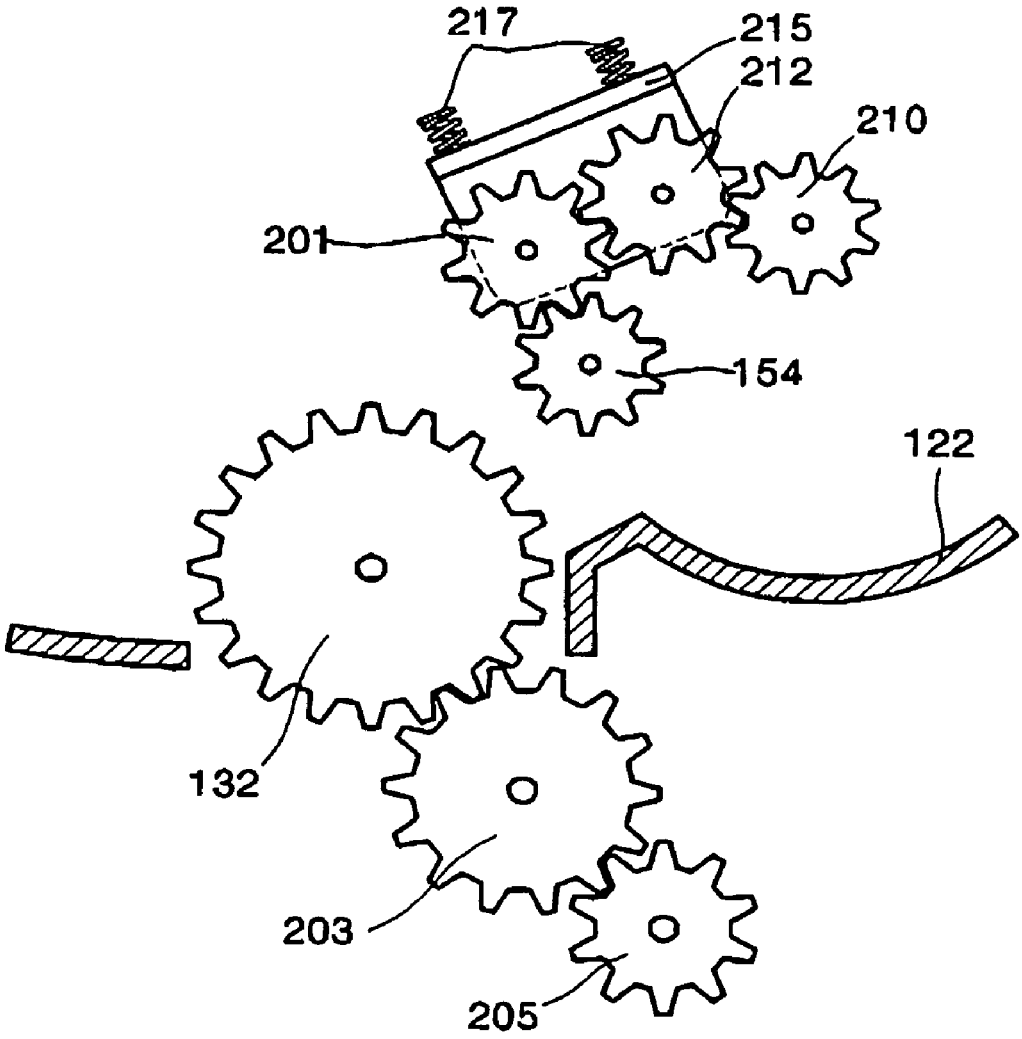
FIG. 5 is a sectional view illustrating power transfer to the development roller and the photosensitive drum in the electrophotographic image forming apparatus of FIG. 2.

FIG. 2 is a schematic sectional view of an electrophotographic image forming apparatus according to an exemplary embodiment of the present invention. FIG. 3 is an exploded perspective view of coupling means for coupling a development roller inside a developer to a motor outside the developer in the electrophotographic image forming apparatus of FIG. 2. FIG. 4 is an exploded perspective view of a photosensitive drum inside the developer of the electrophotographic image forming apparatus of FIG. 2. FIG. 5 is a sectional view illustrating power transfer to the development roller and the photosensitive drum in the electrophotographic image forming apparatus of FIG. 2.

Referring to FIG. 2, an electrophotographic image forming apparatus 100 includes a housing 101. A light scanning unit 110 and a developer 120 are disposed inside the housing 101.

The light scanning unit 110 scans light L corresponding to an image to be printed to a photosensitive medium 130, which will be explained later, to form an electrostatic latent image on an outer peripheral surface of the photosensitive medium 130. The light scanning unit 110 includes a light source (not shown) for emitting a laser beam and a beam deflector for deflecting the laser beam emitted from the light source. A polygonal mirror 112, which scans light while rotating due to a driving source, may be employed as the beam deflector, as shown in FIG. 2. A hologram disc (not shown), which deflects light using a diffractive hologram pattern formed on a disc surface, may also be employed instead of the polygonal mirror 112.

The developer 120 is a cartridge that is detachably mounted inside the housing 101. A developer frame 122 forms the outer frame of the developer 120. The photosensitive medium 130, a charge roller 139, a waste toner cleaner 138, a development roller 140, a doctor blade 158, a supply roller 160, and an agitator 162 are disposed within the developer frame 122. A waste toner storage chamber 123, which stores waste toner stripped off from the outer peripheral surface of the photosensitive medium 130, and a toner storage chamber 125, which stores toner (a developing agent), are disposed within the developer frame 122. When the toner contained in the toner storage chamber 125 of the developer 120 is used up, the developer is replaced with a new one. A door 103 is formed on an upper portion of the housing 101 to allow the developer 120 to be installed in the housing 101 therethrough.

The photosensitive medium 130 is a cylindrical metal drum. An outer peripheral surface of the photosensitive medium 130 has a photoconductive material layer formed by evaporation-coating or the like. The photosensitive drum 130 is charged to a predetermined potential by means of the charge roller 139, and the electrostatic latent image corresponding to the image to be printed is formed on the outer peripheral surface of the photosensitive drum 130 using the light emitted from the light scanning unit 110 as described above. The development roller 140 transfers the toner to the photosensitive drum 130 with the electrostatic latent image formed thereon to develop the electrostatic latent image into a visible toner image. The supply roller 160 supplies the toner to the development roller 140, and the agitator 162 stirs the toner contained in the toner storage chamber 125 to substantially prevent clumping of the toner. The doctor blade 158 controls the thickness of the toner that is supplied from the supply roller 160 and adhered to the outer peripheral surface of the development roller 140. The waste toner cleaner 138 scrubs waste toner that is not transferred to a printing paper P and remains on the outer peripheral surface of the photosensitive drum 130. The removed waste toner is collected in the waste toner storage chamber 123.

A transfer roller 170 is installed to face the outer peripheral surface of the photosensitive drum 130. The visible toner image developed on the outer peripheral surface of the photosensitive drum 130 is transferred to the printing paper P passing between the transfer roller 170 and the photosensitive drum 130 due to a transfer bias voltage or a contact pressure between the photosensitive drum 130 and the transfer roller 170.

A fixing unit 175 includes a heat roller 176 and a pressure roller 177 facing the heat roller 176. When the printing paper P to which the visible toner image is transferred passes between the heat roller 176 and the pressure roller 177, the image is fixed to the printing paper P due to heat and pressure.

The electrophotographic image forming apparatus 100 further includes first and second pickup rollers 180 and 182, which pick up printing papers P one by one from stacks on first and second paper cassettes 105 and 106, respectively. The electrophotographic image forming apparatus 100 includes a paper aligner 190, which aligns the printing paper P so that the toner image may be transferred to a desired position of the printing paper P before the printing paper P passes through the photosensitive drum 130 and the transfer roller 170 along printing path 41. The electrophotographic image forming apparatus 100 includes a paper discharge roller 179 that discharges the printing paper P passing through the fixing unit 175 and having the printed image thereon to a discharged paper support 102 installed outside the housing 101.

The photosensitive drum 130 is charged to the predetermined potential by means of the charge roller 139, and responds to the light beam L scanned from the light scanning unit 110 to form the electrostatic latent image corresponding to the image to be printed on the outer peripheral surface thereof. The toner contained in the toner storage chamber 125 of the developer 120 is stirred by the agitator 162, and is supplied to the photosensitive drum 130 with the electrostatic latent image thereon through the supply roller 160 and the development roller 140 to develop the visible toner image on the outer peripheral surface of the photosensitive drum 130. The printing paper P loaded on top of the first or second paper cassette 105 or 106 is picked up by the pickup roller 180 or 182, and is fed and aligned by the paper aligner 190 to pass between the photosensitive drum 130 and the transfer roller 170. The visible toner image developed on the outer peripheral surface of the photosensitive drum 130 is transferred to a surface of the printing paper P facing the photosensitive drum 130. The visible toner image transferred to the printing paper P is fixed to the printing paper P while passing through the fixing unit 175 due to heat and pressure, and then paper P is conveyed by the discharge roller 179 to be loaded on the discharged paper support 102.

Referring to FIG. 3, the development roller 140 rotatably positioned inside the developer frame 122 is coupled to the developer frame 122 by coupling means. The coupling means includes a development roller end portion 143, a gear member 150, and a disc 145 disposed between the development roller end portion 143 and the gear member 150.

The gear member 150 is rotatably accommodated in a receiving groove 128 formed in the developer frame 122. The gear member 150 includes a gear portion 154 with teeth. The gear portion 154 passes through an aperture 127 formed in the developer frame 122 to be exposed outside of the developer frame 122. The gear member 150 further includes a pair of first protrusions 152 extending toward the development roller 140.

The development roller end portion 143 may be fixed as a separate member to a front end of the development roller 140, or may be integrally formed with the front end of the development roller 140. The development roller end portion 143 includes a pair of second protrusions 144 extending toward the gear member 150.

Slots 146 and 147 extending from an outer circumferential surface toward a central part are formed in the disc 145. The slots 146 are a pair of first slots for receiving the pair of first protrusions 152 of the gear member 150, and the slots 147 are a pair of second slots 147 for receiving the pair of second protrusions 144 of the development roller end portion 143.

The coupling means is assembled by disposing the disc 145 between the gear member 150 and the development roller end portion 143 so that the first slots 146 of the disc 145 receive the first protrusions 152 and the second slots 147 receive the second protrusions 144. The gear member 150 is inserted in the receiving groove 128 so that the gear portion 154 of the gear member 150 passes through the aperture 127 of the developer frame 122. When the gear member 150 of the assembled coupling means rotates, the first protrusions 152 move to rotate the disc 145, and the rotating disc 145 moves the second protrusions 144 to rotate the development roller end portion 143. Thus, when the gear member 150 rotates, the disc 145 and the development roller end portion 143 rotate in the same direction about the same rotational shaft, which is indicated by a dash-dot line, as the gear member 150.

A gear portion 141 is formed on an outer peripheral surface of the front end of the development roller 140 to engage the supply roller 160 and the agitator 162.

Referring to FIG. 4, a rotary shaft 131 of a front end of the photosensitive drum 130 is rotatably inserted into a receiving groove 126 formed in the developer frame 122 such that the photosensitive drum 130 is mounted inside the developer frame 122. A gear portion 132 is formed on an outer peripheral surface of the front end of the photosensitive drum 130.

As shown in FIG. 5, if the developer 120 is mounted inside the housing 101, the gear portion 154 of the gear member 150 meshes with a first gear 201, and the gear portion 132 of the photosensitive drum 130 meshes with a second gear 203. The first gear 201 and the second gear 203 transfer a rotational force to the development roller 140 and the photosensitive drum 130, respectively.

To prevent damage to the gear portion 154 and the first gear 201 due to a confliction therebetween when the developer 120 is mounted inside the housing 101, the first gear 201 is supported by buffer means. The buffer means includes a bracket 215, which rotatably supports the first gear 201, and a spring 217, which elastically supports the bracket 215. If the first gear 201 conflicts with the gear portion 154 when the developer 120 is moved into and mounted inside the housing 101, the spring 217 is pushed by the gear portion 154 to be contracted, thereby preventing damage to the gear portion 154 and the first gear 201. Further, since the spring 217 presses the bracket 215 toward the gear portion 154 while the developer 120 is mounted inside the housing 101, the first gear 201 and the gear portion 154 contact each other closely. The bracket 215 also rotatably supports a connection gear 212, which meshes with the first gear 201. The connection gear 212 meshes with a shaft 210 of a development roller driving motor (not shown). Accordingly, when the shaft 210 of the development roller driving motor rotates, the rotational force of the shaft 210 is sequentially transferred to the connection gear 212, the first gear 201, and the gear portion 154 of the gear member 150, and is sequentially transferred to the gear member 150, the disc 145, and the development roller end portion 143, thereby causing the development roller 140 to rotate.

Although the gear member 150 meshing with the first gear 201 rotates due to the first gear 201, the development roller 140 rotates due to the coupling means including the gear member 150, the disc 145, and the development roller end portion 143. Consequently, the rotational speed of the development roller 140 and a gap between the development roller 140 and the photosensitive drum 130 are prevented from varying due to the meshing relation.

The second gear 203 meshes with a shaft 205 of a main motor (not shown), which drives the rollers in a path through which the printing paper P is conveyed. Accordingly, when the shaft 205 of the main motor rotates while the developer 120 is mounted inside the housing 101, the rotational force of the shaft 205 is sequentially transferred to the second gear 203 and the gear portion 132 of the photosensitive drum 130, thereby causing the photosensitive drum 130 to rotate.

Since the shaft 205 of the main motor continues to rotate until the printing paper P is picked up by the pickup roller 180 or 182 and is discharged to the outside of the housing 101 by the discharge roller 179, the photosensitive drum 130 continues to rotate during that time. However, since the development roller 140 needs to rotate only when the visible toner image is developed on the outer peripheral surface of the photosensitive drum 130, the shaft 210 of the development roller driving motor may be controlled to rotate only when the visible toner image is developed. Thus, the agitator 162 geared with the development roller 140 also rotates during a shorter time compared with a conventional agitator. Accordingly, it leads to a reduction in so-called toner stress, which is caused when the toner is stirred for a long time and an external additive, such as wax and a charge-supplementing agent coated on the toner, is separated from the toner to deteriorate the quality of the image.

The developer and the electrophotographic image forming apparatus having the developer according to the present invention have the following advantages.

First, since the means for transferring the rotational power to the developer is not connected to the door to operate when the door is opened and closed, the structure is simple and the number of parts required is reduced, thereby making assembly easy and reducing production costs.

Second, since the developer frame and the development roller are coupled to each other by the coupling means, the development roller may rotate at a substantially constant speed and the gap therebetween may be maintained substantially constant, thereby improving the quality of printed image.

Third, since the agitator according to the desired embodiment operates for a shorter time compared with the conventional agitator, toner stress is reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A developing unit, comprising:

a developer frame in which a developing agent is contained;

a development roller rotatably disposed inside the developer frame;

rotatable coupling means connecting the development roller to the developer frame;

a gear member rotatably substantially disposed in a developer frame aperture adapted to engage a first gear disposed outside the developing unit to transfer a rotational force therebetween; and a development roller end portion disposed between the development roller and the rotatable coupling means and that rotates with the gear member in the same direction about the same rotational axis as the gear member.

2. The developing unit of claim 1, wherein a gear portion of the gear member is adapted to engage the first gear, and the gear portion is adapted to pass through the developer frame to be exposed outside of the developer frame.

3. The developing unit of claim 1, wherein a first protrusion extends from the gear member toward the development roller, a second protrusion extends from the development roller end portion toward the gear member, and a disc is disposed between the gear member and the development roller end portion to receive the first protrusion and the second protrusion such that rotation of the gear member rotates the first protrusion to rotate the disc, and the rotation of the disc rotates the second protrusion to rotate the development roller end portion.

4. The developing unit of claim 1, wherein a supply roller adapted to supply the developing agent to the development roller and an agitator adapted to stir the developing agent are disposed inside the developer frame, the development roller being geared with the supply roller and the agitator such that rotation of the development roller rotates the supply roller and the agitator rotate together with the development roller.

5. The developing unit of claim 1, wherein a photosensitive medium on which an electrostatic latent image corresponding to an image to be printed is formed thereon through light scanning is disposed inside the developer frame, the photosensitive medium being rotatably engaged with a second gear disposed outside the developing unit to transfer a rotational force therebetween.

6. An electrophotographic image forming apparatus, comprising:

a photosensitive medium on which an electrostatic latent image corresponding to an image to be printed is formed through light scanning;

a developing unit adapted to apply a developing agent to the photosensitive medium to develop the image into a visible image;

a developer frame in which the developing agent is contained;

a development roller rotatably disposed inside the developer frame;

rotatable coupling means connecting the development roller to the developer frame;

a gear member rotatably substantially disposed in a developer frame aperture and engaging a first gear disposed outside the developing unit to transfer a rotational force; and a development roller end portion disposed between the development roller and the rotatable coupling means and engaging the gear member to rotate in the same direction about the same rotational axis as the gear member.

7. The apparatus of claim 6, wherein a gear portion of the gear member engages the first gear, and the gear portion is adapted to pass through the developer frame to be exposed outside of the developer frame.

8. The apparatus of claim 6, wherein a first protrusion extends from the gear member toward the development roller, a second protrusion extends from the development roller end portion toward the gear member, and a disc is disposed between the gear member and the development roller end portion to receive the first protrusion and the second protrusion, rotation of the gear member rotates the first protrusion to rotate the disc, and rotation of the disc rotates the second protrusion to rotate the development roller end portion.

9. The apparatus of claim 6, wherein a supply roller adapted to supply the developing agent to the development roller and an agitator adapted to stir the developing agent are disposed inside the developer frame, the supply roller and the agitator being engaged with the development roller such that rotation of the development roller rotates the supply roller and the agitator together with the development roller.

10. The apparatus of claim 6, wherein the photosensitive medium is positioned inside the developer frame, the photosensitive medium being rotatably engaged with a second gear disposed outside the developer to transfer a rotational force therebetween.

11. The apparatus of claim 10, wherein the first gear and the second gear are driven by different motors.

12. The apparatus of claim 6, wherein buffer means supporting the first gear prevents damage due to a confliction between the first gear and the gear member.

13. The apparatus of claim 12, wherein a bracket of the buffer means rotatably supports the first gear.

14. The apparatus of claim 13, wherein an elastic member elastically supports the bracket.

15. The apparatus of claim 14, wherein the elastic member is a spring.

16. An electrophotographic image forming apparatus, comprising:

a developing unit adapted to apply a developing agent to a photosensitive medium of the electrophotographic image forming apparatus to develop a visible image;

a developer frame in which the developing agent is contained;

a development roller rotatably disposed inside the developer frame, an aperture being positioned in the developer frame;

a gear member having a gear portion including a plurality of teeth, the gear portion being rotatably substantially disposed in the developer frame aperture and adapted to engage a first gear disposed outside the developing unit to transfer a rotational force therebetween; and an end portion of the development roller engaging the gear member to rotate in the same direction about the same rotational axis as the gear member.

17. The apparatus of claim 16, wherein a first protrusion extends from the gear member toward the development roller, a second protrusion extends from the development roller end portion toward the gear member, and a disc is disposed between the gear member and the development roller end portion to receive the first protrusion and the second protrusion, rotation of the gear member rotates the first protrusion to rotate the disc, and rotation of the disc rotates the second protrusion to rotate the development roller end portion.

18. The apparatus of claim 16, wherein a supply roller adapted to supply the developing agent to the development roller and an agitator adapted to stir the developing agent are disposed inside the developer frame, the supply roller and the agitator being engaged with the development roller such that rotation of the development roller rotates the supply roller and the agitator together with the development roller.

19. The apparatus of claim 16, wherein the photosensitive medium is positioned inside the developer frame, the photosensitive medium being rotatably engaged with a second gear disposed outside the developing unit to transfer a rotational force therebetween.

20. The apparatus of claim 19, wherein the first gear and the second gear are driven by different motors.

* * * * *